US009742096B2

(12) United States Patent
Lee et al.

(10) Patent No.: US 9,742,096 B2
(45) Date of Patent: Aug. 22, 2017

(54) PROTECTIVE STRUCTURES FOR CONNECTOR CONTACTS

(71) Applicant: APPLE INC., Cupertino, CA (US)

(72) Inventors: Jae Hwang Lee, San Jose, CA (US); Zheng Gao, San Jose, CA (US); Daniel A. Bergvall, San Jose, CA (US)

(73) Assignee: APPLE INC., Cupertino, CA (US)

( * ) Notice: Subject to any disclaimer, the term of this patent is extended or adjusted under 35 U.S.C. 154(b) by 0 days.

(21) Appl. No.: 14/870,970

(22) Filed: Sep. 30, 2015

(65) Prior Publication Data

US 2016/0093964 A1 Mar. 31, 2016

Related U.S. Application Data

(60) Provisional application No. 62/057,948, filed on Sep. 30, 2014.

(51) Int. Cl.

| | |
|---|---|
| ***H01R 13/04*** | (2006.01) |
| ***H01R 13/506*** | (2006.01) |
| ***H01R 13/514*** | (2006.01) |
| ***H01R 13/627*** | (2006.01) |

(52) U.S. Cl.

CPC ..... *H01R 13/506* (2013.01); *H01R 13/514* (2013.01); *H01R 13/627* (2013.01)

(58) Field of Classification Search

CPC .. H01R 13/502; H01R 13/506; H01R 13/514; H01R 13/627

USPC ..... 439/137, 660, 693

See application file for complete search history.

(56) References Cited

U.S. PATENT DOCUMENTS

| | | | | |
|---|---|---|---|---|
| 6,038,130 | A * | 3/2000 | Boeck | H01R 9/2675 361/729 |
| 6,325,633 | B1 * | 12/2001 | Ito | H01R 13/187 439/246 |
| 7,467,960 | B1 * | 12/2008 | Harlan | H01R 13/03 439/181 |
| 8,968,032 | B2 * | 3/2015 | Nomiyama | H01R 13/6315 439/660 |
| 2015/0037985 | A1 * | 2/2015 | Chang | H01R 12/707 439/64 |

* cited by examiner

*Primary Examiner* — Khiem Nguyen

(74) *Attorney, Agent, or Firm* — Kilpatrick Townsend & Stockton, LLP

(57) ABSTRACT

Connector receptacles having protective structures for connector contacts. One example may provide a connector receptacle having one or more contacts that are reinforced with a protective piece around a portion of the contact. Another example may provide a connector receptacle having two or more contacts reinforced with adjacent protective pieces to provide additional protective reinforcement. Another example may provide a connector receptacle having two or more contacts reinforced with interlocking protective pieces. These protective pieces may protect contacts in a connector receptacle from damage when a device, module, or connector insert is inserted into the connector receptacle at an oblique angle, when a device, module, or insert is stressed while in the receptacle, or when a device, module, or insert is removed from the receptacle at an oblique angle.

20 Claims, 15 Drawing Sheets

PROTECTIVE STRUCTURES FOR CONNECTOR CONTACTS

CROSS-REFERENCES TO RELATED APPLICATIONS

This application is a nonprovisional of and claims priority to U.S. patent provisional application No. 62/057,948, filed Sep. 30, 2014, which is incorporated by reference.

BACKGROUND

The number and types of electronic devices available to consumers have increased tremendously the past few years, and this increase shows no signs of abating. Electronic devices, such as portable media players, storage devices, tablets, netbooks, laptops, desktops, all-in-one computers, wearable computing devices, cell, media, and smart phones, televisions, monitors, and other display devices, navigation systems, and other devices have become ubiquitous.

These electronic devices may include one or more connector receptacles, which may often appear as a cavity on a side of an electronic device. These receptacle cavities may be arranged to receive a second electronic device or a connection to a second electronic device. For example, they may be arranged to receive a device such a memory or circuit module device. These devices may include cards such as Secure Digital cards, memory sticks, compact flash, wireless transceivers, and other types of cards and modules. The receptacle cavity may also be arranged to receive a connector insert, which may be connected to a cable, a docking station, or other electronic component.

These devices have become smaller and slimmer with each succeeding generation. At the same time, they have been designed to include ever-increasing levels of functionality. The trend for the foreseeable future is to pack more features into increasingly smaller devices. As a result, many parts of these devices, such as casings, power supplies, and circuits have become smaller. It may be desirable to further reduce the size of other components as well. For example, it may be desirable to reduce the size of these connector receptacles. Space saved by providing a reduced size connector receptacle may be used to shrink the size of the electronic device, it may be used to increase functionality, or both.

The connector receptacle may include a number of contacts to mate with contacts on these devices or inserts. These electrical connections pathways may form paths for power and data. When a connector receptacle is made smaller, its contacts may become smaller as well. These smaller contacts may be increasingly vulnerable to damage.

Thus, what is needed are connector receptacles having protective structures for connector contacts.

SUMMARY

Accordingly, embodiments of the present invention provide connector receptacles having protective structures for connector contacts. An illustrative embodiment of the present invention may provide a connector receptacle having one or more contacts that are reinforced with protective nonconductive pieces around a portion of one or more contacts. The protective pieces may have an opening for contacting portions of the contacts such that electrical connections may be made between the contacts and contacts on a device, module, or connector insert. The reinforcing protective pieces may protect contacts in a connector receptacle from damage when a device, module, or connector insert is inserted into the connector receptacle at an oblique angle, when a device, module, or insert is stressed while in the receptacle, or when the device, module, or connector insert is removed from the receptacle at an oblique angle.

Another illustrative embodiment of the present invention may provide a connector receptacle having two or more contacts, where each contact is reinforced with a protective nonconductive piece around a portion of the contact. These protective pieces may be adjacent to each other to provide additional protective reinforcement. These adjacent pieces may protect contacts in a connector receptacle from damage.

Another illustrative embodiment of the present invention may provide a connector receptacle having two or more contacts, where each contact is reinforced with a protective nonconductive piece around a portion of the contact. These protective pieces may interlock with each other to provide additional protective reinforcement. These interlocking pieces may protect contacts in a connector receptacle from damage.

In various embodiments of the present invention, the protective pieces may interlock in various ways. For example, a first piece may have a lengthwise tab. This tab may fit in a lengthwise slot in a second piece. This interlocking arrangement may allow some relative movement between the pieces and therefore their contacts. This may help in ensuring that the contacts in the receptacle are sufficiently planar to make contact with corresponding contacts on a device, module, or connector inset.

Another illustrative embodiment of the present invention may provide a connector receptacle having two or more contacts, where the two or more contacts are reinforced with a protective nonconductive piece around portions of both of the contacts. This protective piece may be adjacent or interlocking with other similar pieces to provide additional protective reinforcement. These pieces may protect contacts in a connector receptacle from damage.

Another illustrative embodiment of the present invention may provide a connector receptacle having a housing having a bottom surface. The bottom surface may have one or more openings. These various reinforcing protective pieces may be located in the openings in the bottom surface of the housing to provide additional reinforcement and protection.

In various embodiments of the present invention, the components of the receptacles may be formed in various ways of various materials. For example, contacts or pins and other conductive portions of the receptacles may be formed by stamping, metal-injection molding, machining, micromachining, 3-D printing, or other manufacturing process. The conductive portions may be formed of stainless steel, steel, copper, copper titanium, phosphor bronze, or other material or combination of materials. They may be plated or coated with nickel, gold, or other material. The nonconductive portions, such as the protective pieces, the receptacle housings and other portions, may be formed using injection or other molding, 3-D printing, machining, or other manufacturing process. The nonconductive portions may be formed of silicon or silicone, rubber, hard rubber, plastic, nylon, elastomers, liquid-crystal polymers (LCPs), ceramics, or other nonconductive material or combination of materials.

Embodiments of the present invention may provide receptacles that may be located in, and may connect to, various types of devices, such as portable computing devices, tablet computers, desktop computers, laptops, all-in-one computers, wearable computing devices, cell phones, smart phones, media phones, storage devices, portable media players, navigation systems, monitors, power supplies, adapters, remote control devices, chargers, and other devices. These connector receptacles may provide pathways for signals and power for cards or other modules, such as Secure Digital cards, Secure Digital High Capacity cards, Secure Digital Extended Capacity cards, Secure Digital Ultra-High-Capacity I cards, Secure Digital Ultra-High-Capacity II cards, memory sticks, compact flash cards, communication modules, and other devices and modules that have been developed, are being developed, or will be developed in the future. These connector receptacles may provide pathways for signals that are compliant with various standards such as Universal Serial Bus (USB), High-Definition Multimedia Interface® (HDMI), Digital Visual Interface (DVI), Ethernet, DisplayPort, Thunderbolt™, Lightning™, Joint Test Action Group (JTAG), test-access-port (TAP), Directed Automated Random Testing (DART), universal asynchronous receiver/transmitters (UARTs), clock signals, power signals, and other types of standard, non-standard, and proprietary interfaces and combinations thereof that have been developed, are being developed, or will be developed in the future.

Various embodiments of the present invention may incorporate one or more of these and the other features described herein. A better understanding of the nature and advantages of the present invention may be gained by reference to the following detailed description and the accompanying drawings.

DESCRIPTION OF ILLUSTRATIVE EMBODIMENTS

Figure 1:
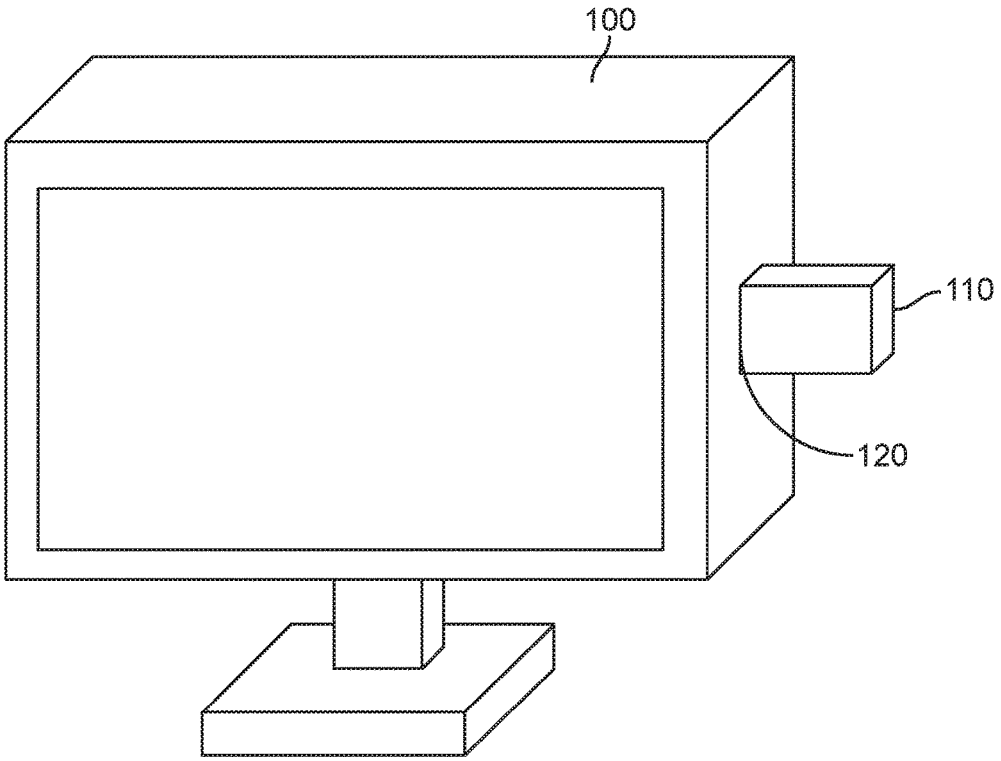
FIG. 1 illustrates an electronic device that may be improved by the incorporation of embodiments of the present invention.

FIG. 1 illustrates an electronic device 100 that may be improved by the incorporation of embodiments of the present invention. In this particular example, electronic device 100 may be a monitor or an all-in-one computer. Other types of electronic devices, such as portable media players, storage devices, tablets, netbooks, laptops, desktops, wearable computing devices, cell, media, and smart phones, televisions, and other display devices, navigation systems, and other types of devices may also be improved by the incorporation of embodiments of the present invention.

In this example, memory card 110 may be inserted into connector receptacle 120 located in the housing of electronic device 100. In a specific embodiment of the present invention, connector receptacle 120 may be arranged to receive a Secure Digital memory card 110. In other embodiments of the present invention, connector receptacle 120 may be configured to receive other types of memory cards or electronic devices, modules, or connections to other electronic devices, such as a cable or docking station insert. These and other devices may be referred to collectively as devices, modules, and inserts.

Again, it may be desirable to reduce the space consumed by connector receptacle 120. By shrinking the space consumed by connector receptacle 120, electronic device 100 may be made smaller, may include additional functionality, or both.

In various embodiments of the present invention, the space consumed by connector receptacle 120 may be reduced by reducing its depth. But reducing the depth of connector receptacle 120 may lead to at least three potential vulnerabilities. The first is that when memory card 110 is inserted into a shallow-depth connector receptacle 120, more of the memory card 110 is exposed outside of the housing of electronic device 100. This leaves memory card 110 vulnerable to being inadvertently hit or struck by other equipment or users.

The second of the vulnerabilities is that a user may incorrectly insert memory card 110. For example, a user may incorrectly insert memory card 110 at an oblique angle relative to the connector receptacle 120. Because connector receptacle 120 is shallow, contacts in connector receptacle 120 may be relatively close to the surface of the housing of electronic device 100. When a user inserts memory card 110 improperly, a corner or edge of memory card 110 may strike one or more contacts at an angle, thereby possibly causing damage. The third vulnerability may occur when a user may incorrectly extract memory card 110 at an oblique angle relative to the connector receptacle 120.

Accordingly, embodiments of the present invention may provide connector receptacles having one or more contacts that are reinforced with a protective nonconductive piece around a portion of each contact. An example is shown in the following figure.

Figure 2:
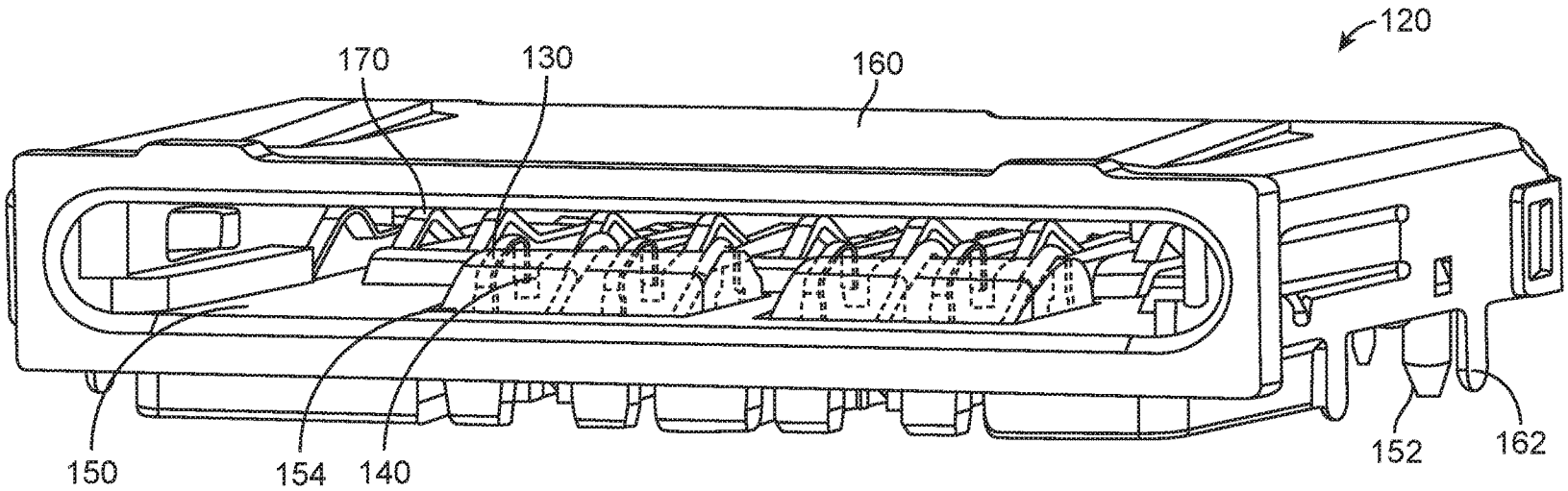
FIG. 2 illustrates a connector receptacle according to an embodiment of the present invention.

FIG. 2 illustrates a connector receptacle according to an embodiment of the present invention. This figure, as with the other included figures, is shown for illustrative purposes and does not limit either the possible embodiments of the present invention or the claims.

Again, it may be desirable to reduce a size of connector receptacle 120. One way to reduce size may be to move contacts 130 closer to a front opening in the connector receptacle. However, this placement may make contacts 130 particularly susceptible to damage. This may be particularly true where contacts 130 are of a small size to form electrical connections with small contacts on a device, module, or connector insert. Damage may occur during an insertion of a device, module, or connector insert into connector receptacle 120. For example, the device, module, or connector insert may be inserted at an oblique angle thereby damaging one or more contacts 130. Damage may also occur after insertion if a device, module, or connector insert is struck or subjected to stress. Damage may also occur during extraction if a device, module, or connector insert is extracted at an oblique angle.

Accordingly, embodiments of the present invention may provide reinforcing protective pieces 140. Protective pieces 140 may be formed at least around a portion of contacts 130. Protective pieces 140 for two or more contacts 130 may be adjacent to each other. This proximity may provide further reinforcement and protection for contacts 130. Protective pieces 140 for two or more contacts 130 may be interlocking with each other. This interlocking may provide further protection for contacts 130. The interlocking pieces may have some freedom of movement an up and down or Z. direction. This may allow contacting portions of contacts 130 to be sufficiently planarized such that they may form electrical connections with corresponding contacts on a device, module, or connector insert.

Receptacle 120 may also include housing 150. Housing 150 may include openings 154. Protective pieces 140 for two or more contacts may be located in an opening 154 in a bottom surface of housing 150. Again, this location may provide additional reinforcement and protection for contacts 130. Housing 150 may include posts 152, which may be placed in openings a printed circuit board or other appropriate substrate in electronic device 100. Shield 160 may substantially surround housing 150. Shield 160 may include tabs 162 that may form ground connections with ground traces or planes in a printed circuit board or other appropriate substrate in electronic device 100. Connector receptacle 120 may further include additional contacts 170. Additional contacts 170 may be arranged in a row behind contacts 130. Additional contacts 170 may be protected from damage by the presence of contacts 130 and protective pieces 140.

Figure 3:
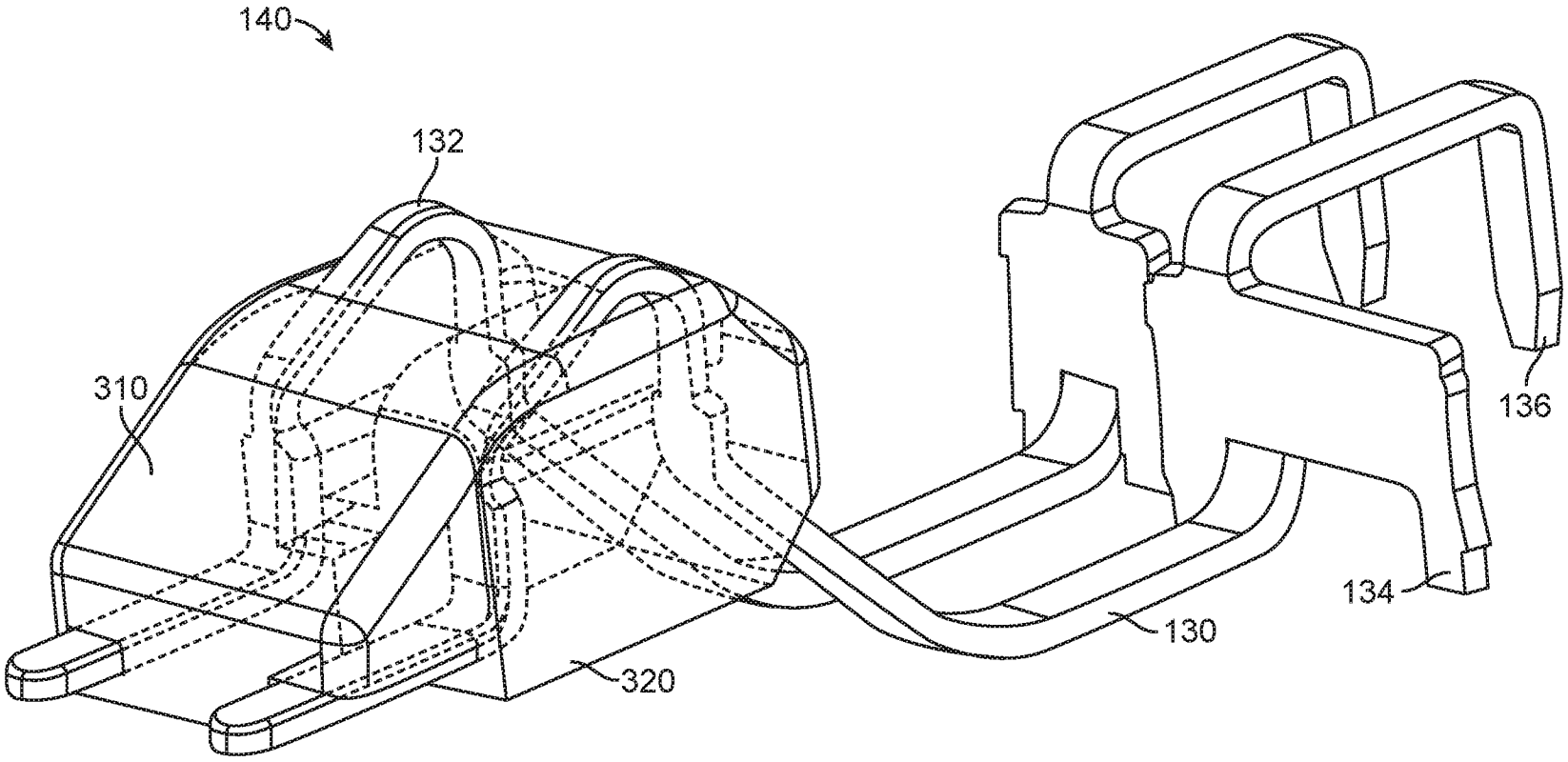
FIG. 3 illustrates a closer view of protective pieces and contacts according to an embodiment of the present invention.

FIG. 3 illustrates a closer view of protective pieces and contacts according to an embodiment of the present invention. In this example, protective pieces 140 may include a first piece 310 and a second piece 320. In this example, piece 310 and 320 may be interlocking Pieces 310 and 320 may be formed around at least a portion of contacts 130. Contacting portions 132 may be exposed at a top of plastic pieces 310 and 320. Contacting portions 132 may form electrical connections with contacts on a device, module, or insert when it is inserted into the connector receptacle.

Contacts 130 may include barbs 134. Burbs 134 may be set in housing 150 in receptacle 120. Barbs 134 may be nested in a staggered manner as shown in this and the other examples. Through-hole contacting portions 136 may be provided at the ends of contacts 130. Through-hole contacting portions 136 may form electrical connections with traces on a printed circuit board or other appropriate substrate in electronic device 100.

Figure 4:
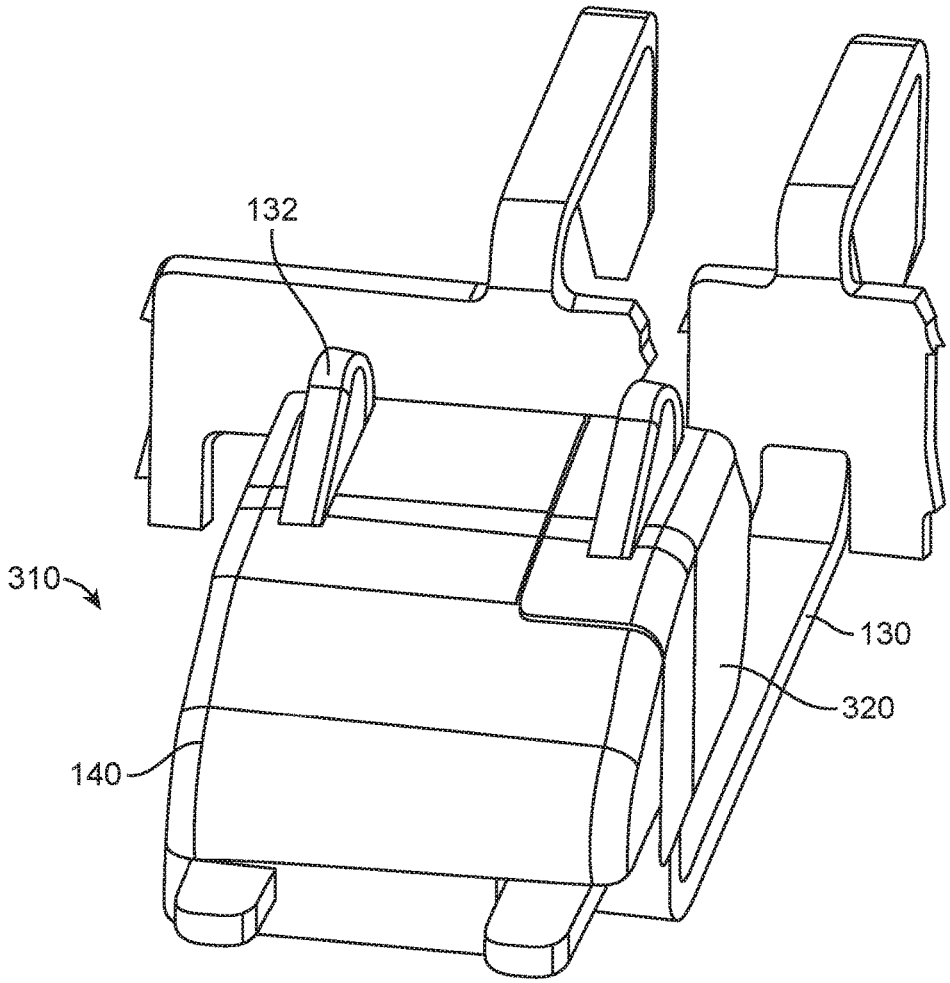
FIG. 4 illustrates another view of protective pieces and contacts according to an embodiment of the present invention.

FIG. 4 illustrates another view of protective pieces and contacts according to an embodiment of the present invention. Again, protective pieces 140 may include interlocking pieces 310 and 320. Contacts 130 may include contacting portions 132, which may be exposed at a top of protective pieces 140. The interlocking pieces 310 and 320 may be able to move a small amount relative to each other. This may ensure that contacting portions 132 are sufficiently planarized such that each contacting portion 132 forms electrical connections with contacts on a device, module, or connector insert that is inserted in receptacle 120.

Figure 5:
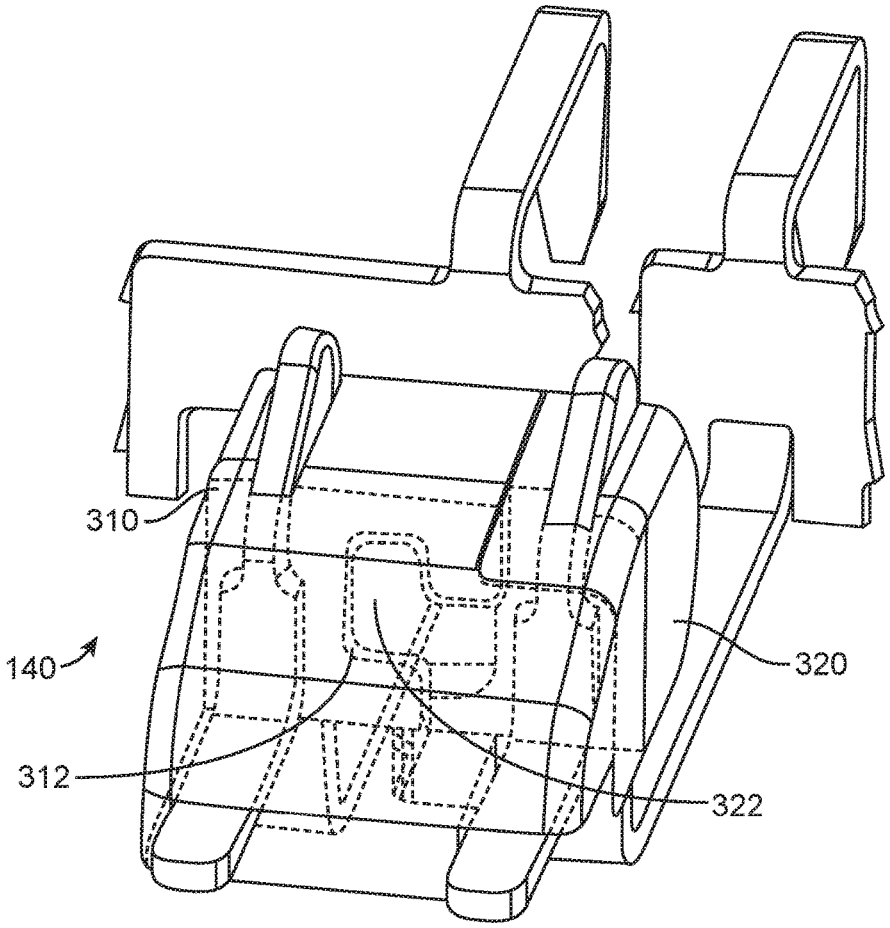
FIG. 5 illustrates a partial cutaway view of protective pieces and contacts according to an embodiment of the present invention.

FIG. 5 illustrates a partial cutaway view of protective pieces and contacts according to an embodiment of the present invention. This cutaway view illustrates the interlocking nature of interlocking pieces 310 and 320. Specifically, a lengthwise tab 322 on protective piece 320 may fit in a lengthwise slot 312 in protective piece 310. These interlocking features may provide reinforcement to further protect contacts 130 from damage due to either and oblique insertion or extraction of a device, module, or connector insert into or out of a receptacle, or a stress placed on a device, module, or connector insert once it is in the receptacle.

Figure 6:
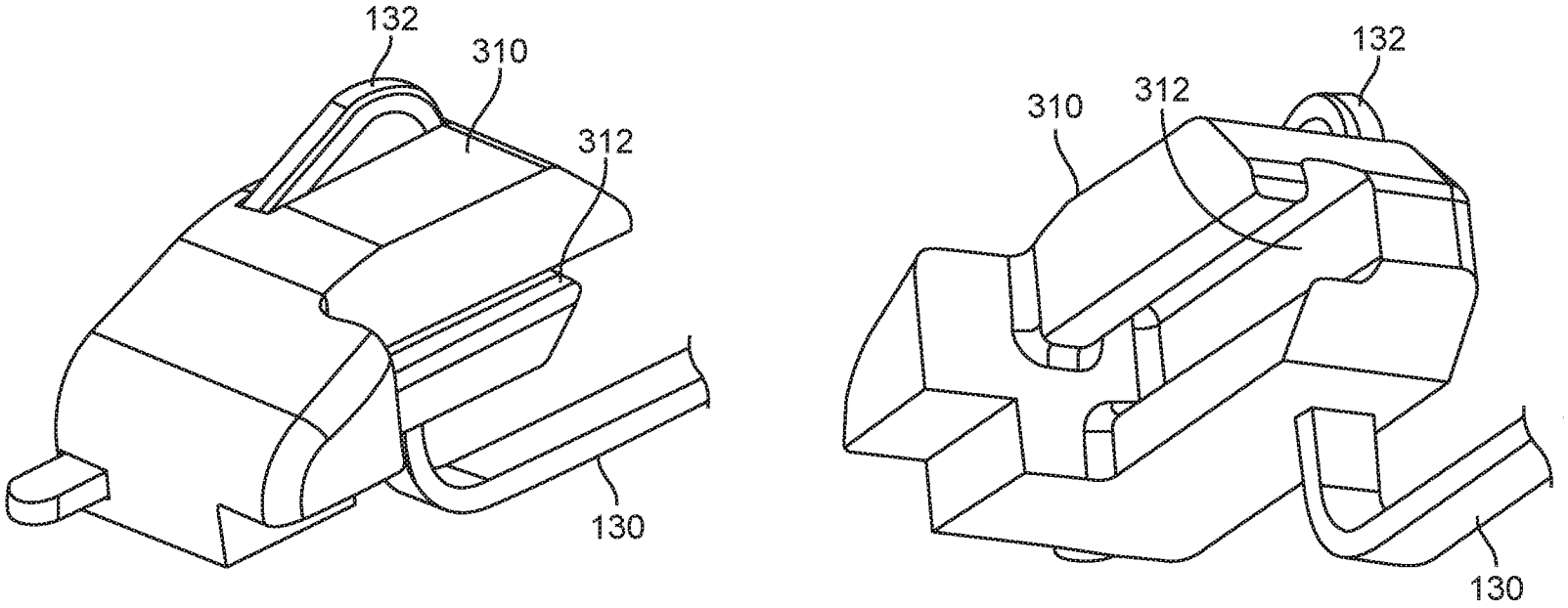
FIG. 6 illustrates a close-up view of a protective piece and a contact according to an embodiment of the present invention.

FIG. 6 illustrates a close-up view of a protective piece and a contact according to an embodiment of the present invention. Again, protective piece 310 may include a lengthwise notch 312. Protective piece 310 may be formed around at least a portion of contact 130. A contacting portion 132 of contact 130 may be exposed at a top of protective piece 310 such that contacting portion 32 may form electrical connections with contacts on a device, module, or connector insert when the device, module, or connector insert is inserted in connector receptacle 120.

Figure 7:
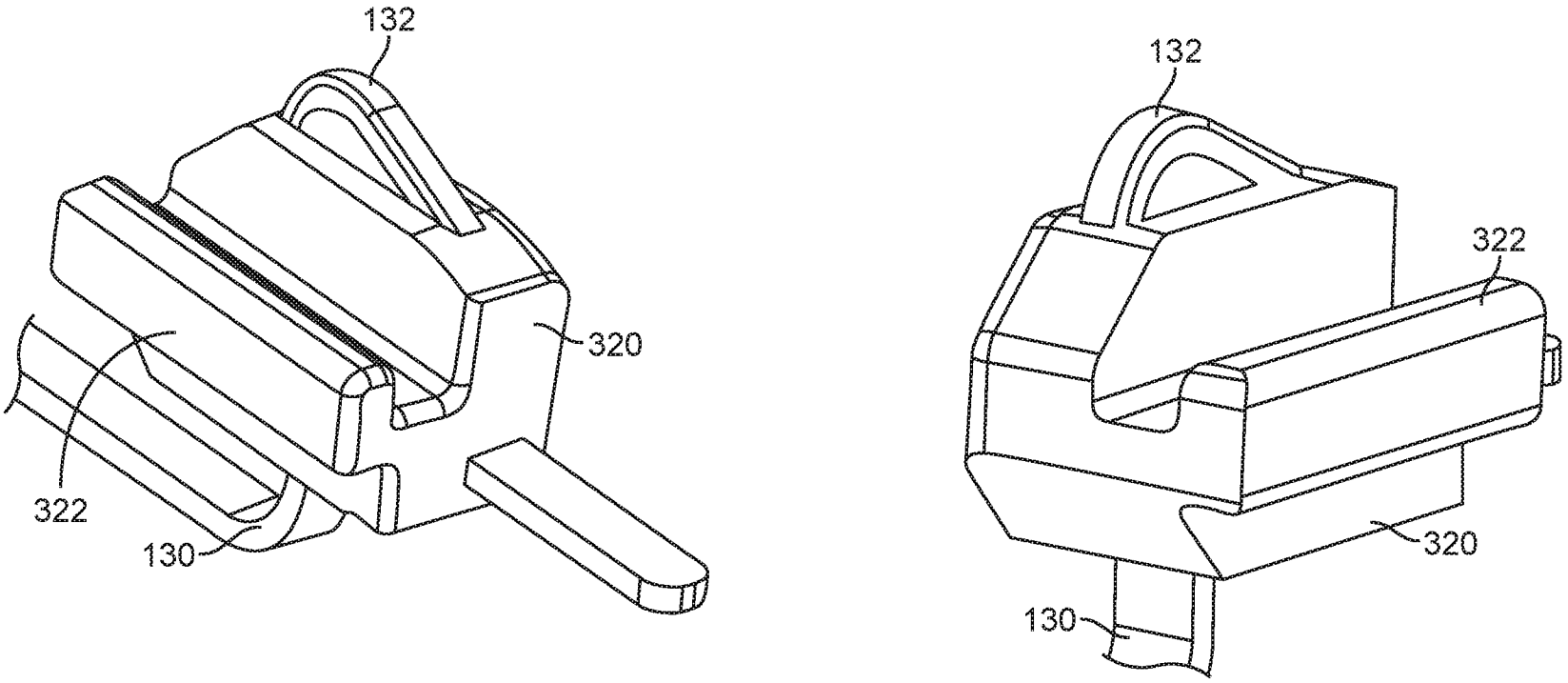
FIG. 7 illustrates a close-up view of a protective piece and a contact according to an embodiment of the present invention.

FIG. 7 illustrates a close-up view of a protective piece and a contact according to an embodiment of the present invention. Again, protective piece 320 may include a lengthwise tab 322. Protective piece 320 may be formed around at least a portion of contact 130. A contacting portion 132 of contact 130 may be exposed a top of protective piece 320 such that contacting portion 320 may form an electrical connection with a contact on a device, module, or connector insert.

Figure 8:
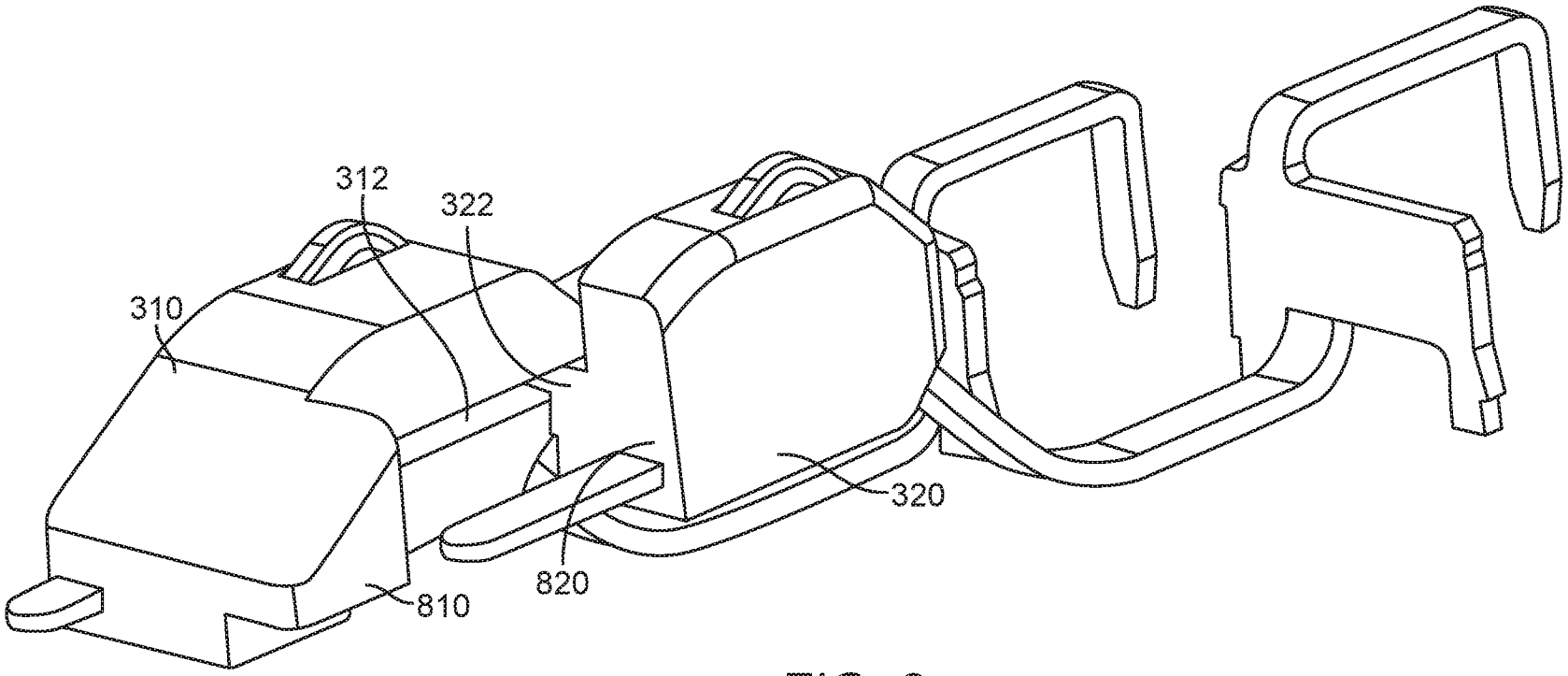
FIG. 8 illustrates an assembly of two protective pieces according to an embodiment of the present invention.

FIG. 8 illustrates an assembly of two protective pieces according to an embodiment of the present invention. In this example, tab 422 on protective piece 320 may be inserted into notch 312 in protective piece 310. Insertion may be complete when face 810 mates with face 820.

Figure 9:
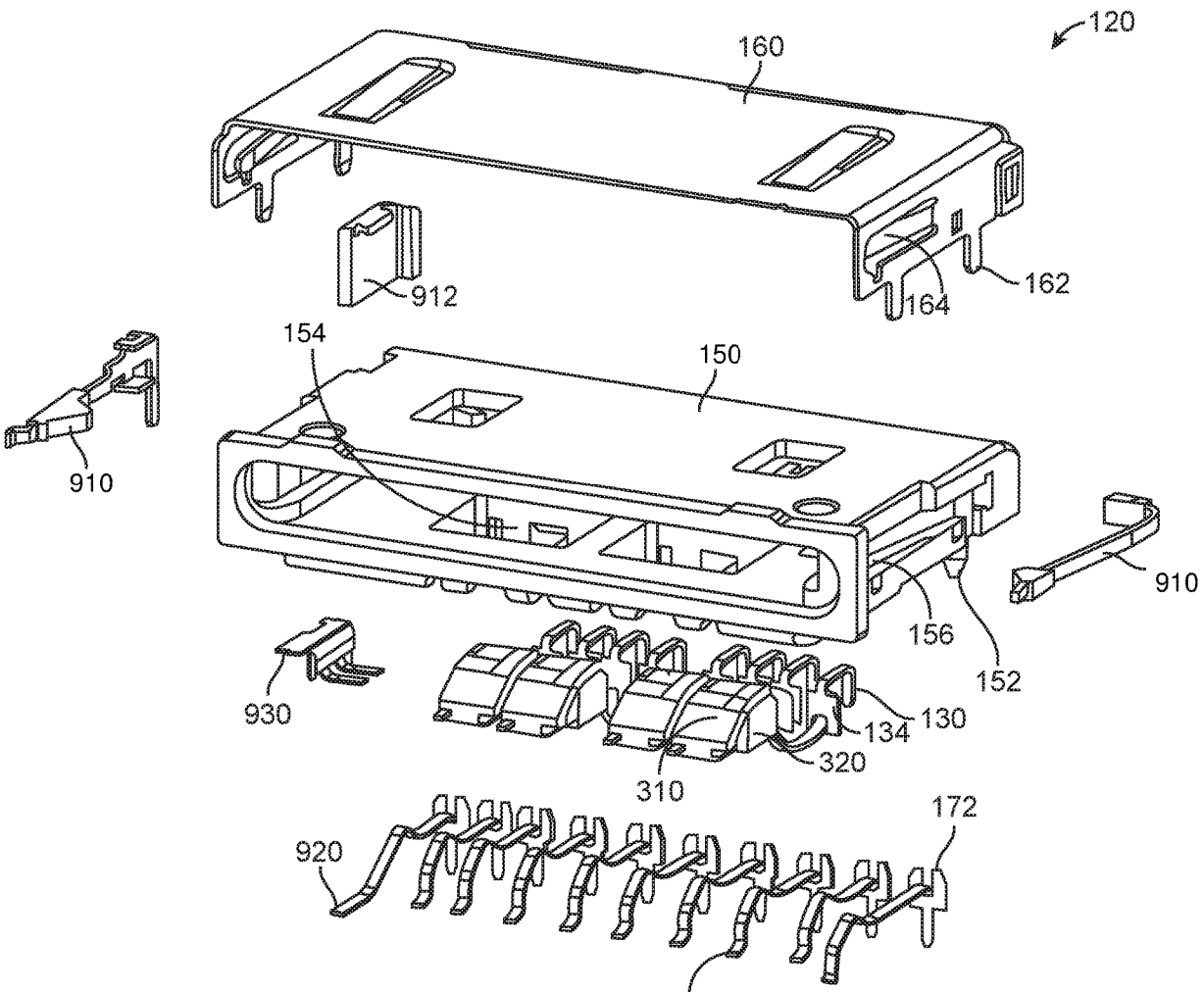
FIG. 9 illustrates an exploded view of a connector receptacle according to an embodiment of the present invention.

FIG. 9 illustrates an exploded view of a connector receptacle according to an embodiment of the present invention. Connector receptacle 120 may include a housing 150. Housing 150 may include a number of openings 154 in a bottom surface. Contacts 130 and protective pieces 310 and 320 may be located in housing 150 such that protective pieces 310 and 320 reside in openings 154. In this example, two sets of protective pieces 310 and 320 may reside in each opening 154. Openings 154 may also provide space for protective pieces 310 and 320 and contacts 130 to deflect during an insertion of a device, module, or insert. Downward facing barbs 134 on contacts 130 may be inserted into corresponding slots or openings in a top surface of a bottom of housing 150. That is, these barbs may be inserted in a top surface of a bottom of housing 150. A second row of contacts 170 may also be inserted into housing 150. Contacts 170 may have upright barbs 172 to fit in a bottom side of the bottom of housing 150. Detect contacts 920 and 930 may also be located in housing 150. Side contacts 910 may be placed in openings 156 in sides of housing 150. Side contacts 910 may help to hold a Secure Data or other card in place when it is inserted into receptacle 120. Receptacle 120 may further include shield 160. Shield 160 may include tabs 164 for holding side ground contacts 910 in place. Shield 160 may further include tab 162, which may be inserted into an opening in a printed circuit board or other appropriate substrate. Plastic pieces 912 may be used to hold side ground contacts 910 in place.

In other embodiments of the present invention, other types of protective pieces may be used. For example, instead of two interlocking pieces around two contacts, a single protective piece may be formed around two contacts. An example is shown in the following figure.

Figure 10:
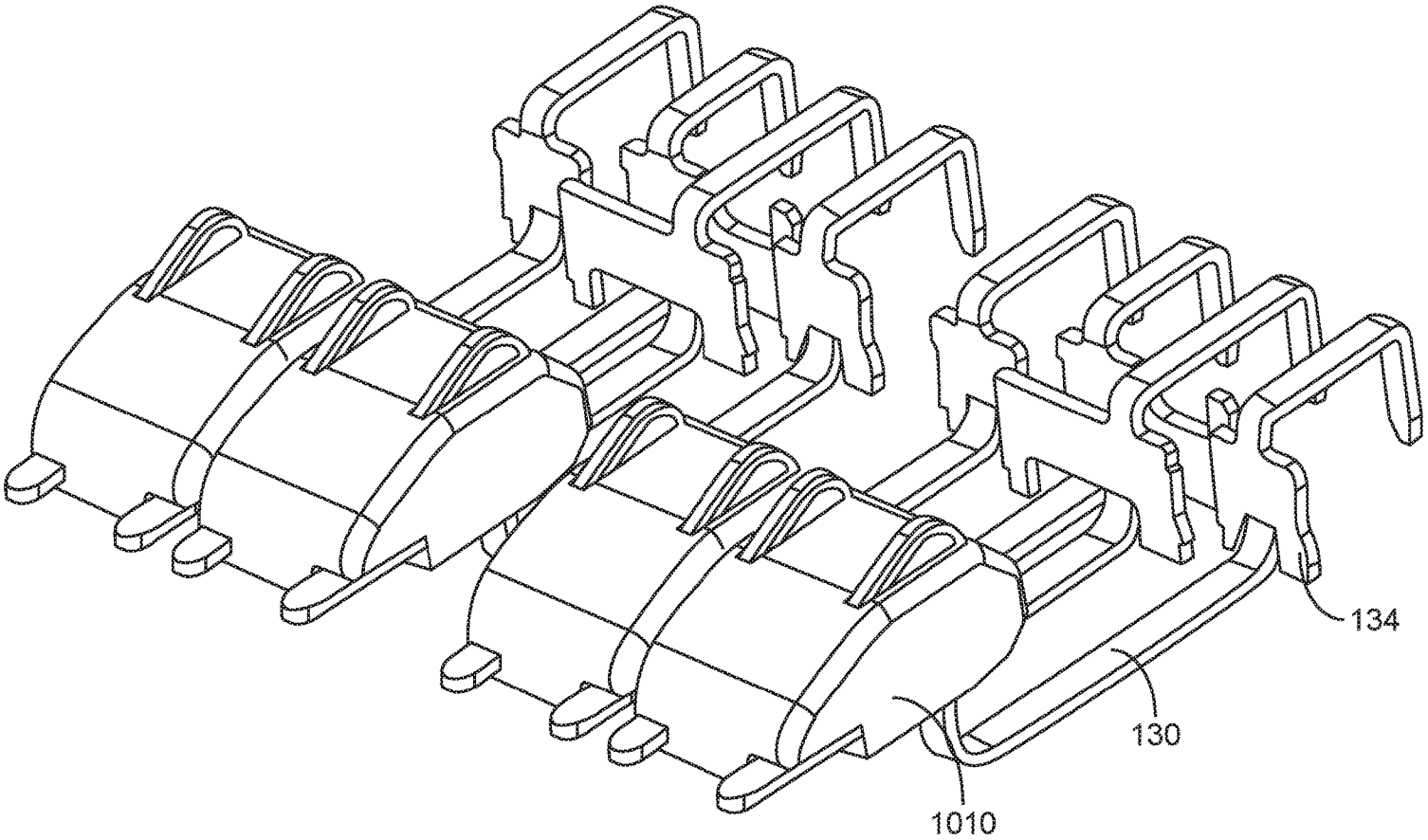
FIG. 10 illustrates protective pieces and contacts according to an embodiment of the present invention.

FIG. 10 illustrates protective pieces and contacts according to an embodiment of the present invention. In this example, a protective piece 1010 may be formed around portions of two or more contacts 130. As before, contacts 130 may include barbs 134. Barbs 134 may be nested as shown. This nesting may allow contacts 130 to be securely inserted in a connector receptacle housing while consuming a minimal amount of area.

In other embodiments of the present invention, a protective piece may be formed around each contact. These contacts may be adjacent to each other for additional protection and reinforcement. An example is shown in the following figure.

Figure 11:
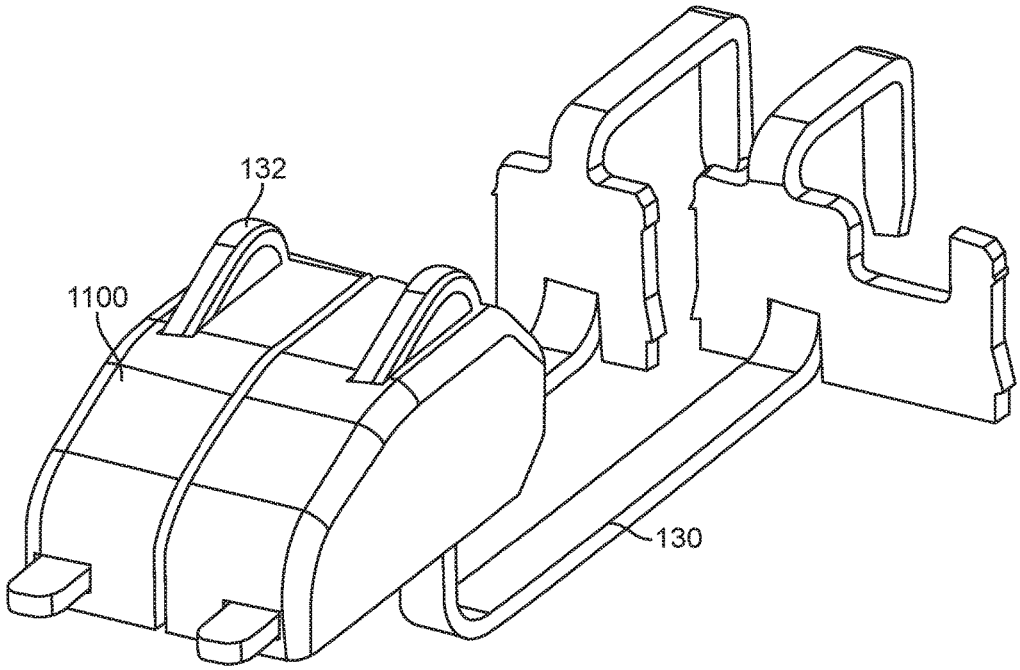
FIG. 11 illustrates protective pieces and contacts according to an embodiment of the present invention.

FIG. 11 illustrates protective pieces and contacts according to an embodiment of the present invention. In this example, protective pieces 1100 may be formed around at least a portion of contacts 130. As in the other examples, a contacting portion 132 may be exposed above these protective pieces 1100 such that the contacting portions 132 may form electrical connections with contacts on a device, module, or connector insert.

In other embodiments of the present invention, instead of protecting contacts with a protective piece, contacts may be located out of a path of insertion for a card until a card is inserted or nearly inserted into a receptacle. This may help protect contacts in a connector receptacle when a device, module, or connector insert is inserted or extracted from a connector receptacle. An example is shown in the following figure.

Figure 12:
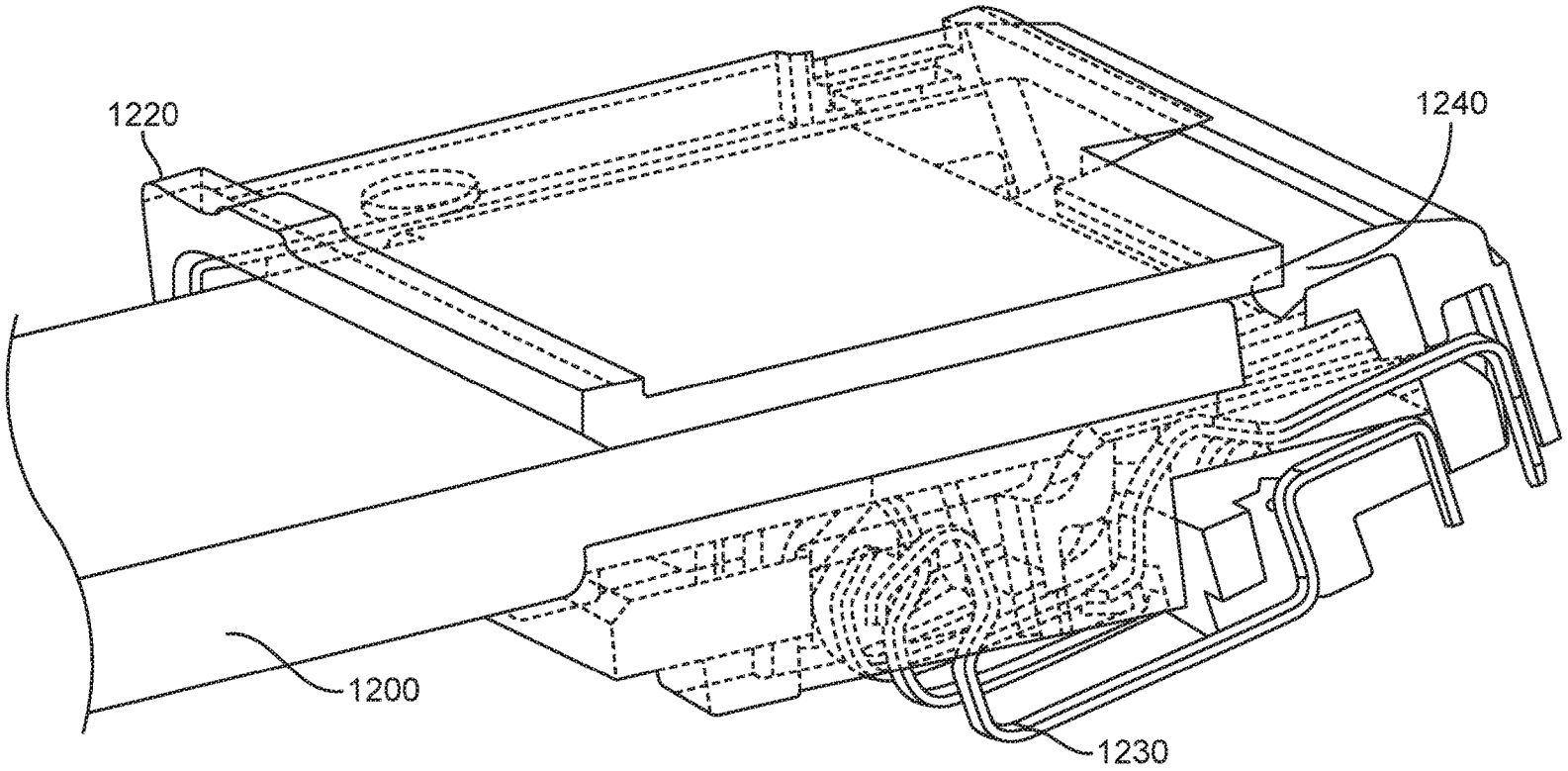
FIG. 12 illustrates an oblique view of a card and connector receptacle according to an embodiment of the present invention.

FIG. 12 illustrates an oblique view of a card and connector receptacle according to an embodiment of the present invention. In this example, card 1200 is being inserted into connector receptacle 1220. Connector receptacle 1220 may include a number of contacts 1230. Contacts 1230 may be out of a path of insertion of card 1200. When card 1200 reaches housing portion 1240 at a back side of connector receptacle 1220, housing portion 1240 may rotate, thereby bringing contacts 1230 into contact with contacts on an underside of card 1200. This is shown further in the following figures.

Figure 13:
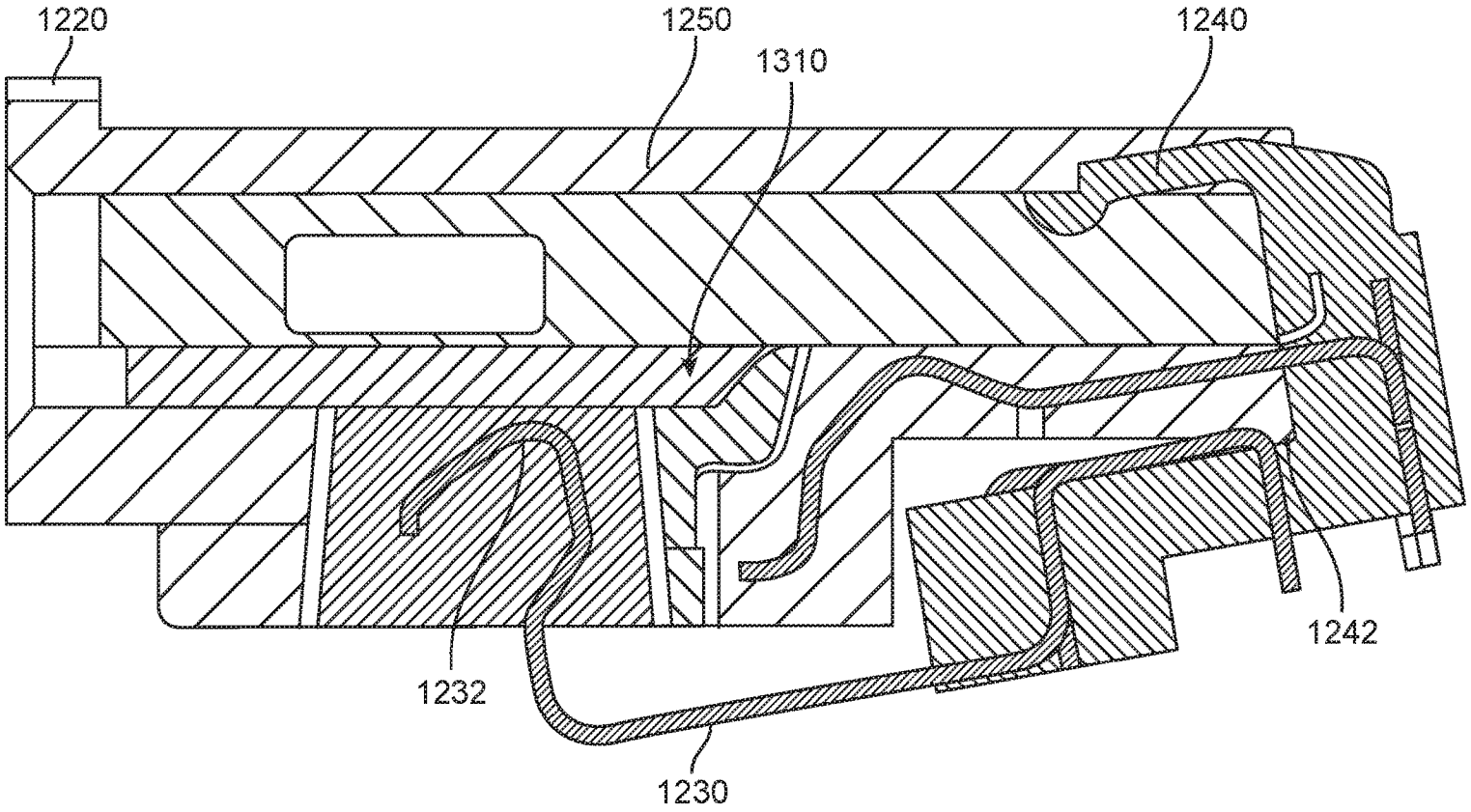
FIG. 13-15 illustrate the insertion of a card into a connector receptacle according to an embodiment of the present invention.
Figure 14:
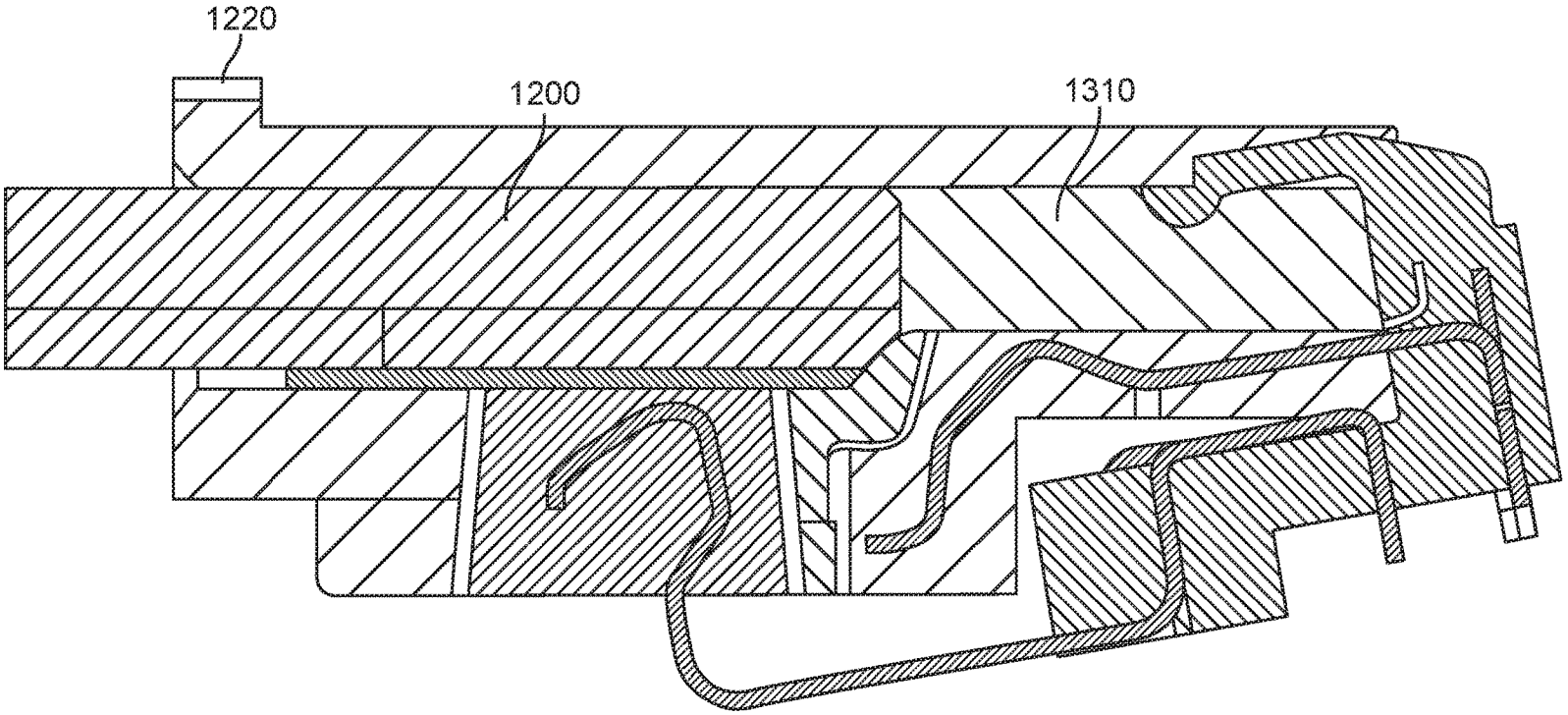
Figure 15:
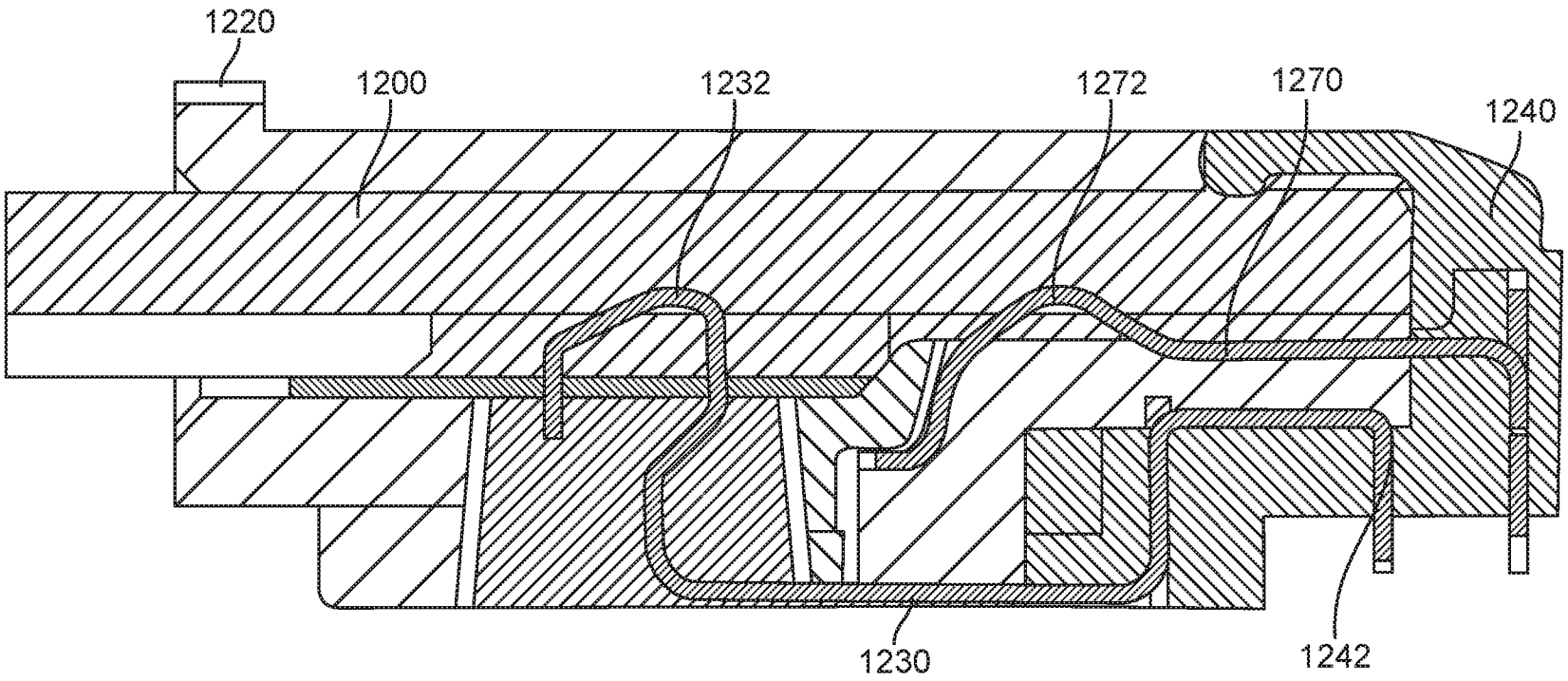

FIG. 13-15 illustrate the insertion of a card into a connector receptacle according to an embodiment of the present invention. FIG. 13 illustrates a side view of a connector receptacle according to an embodiment of the present invention. Again, receptacle 1220 may include an insertion path 1310 for a card. Receptacle 1220 may include a main housing portion 1250 and a rear housing portion 1240. Rear housing portion 440 may rotate around the location 1242. When a card is not inserted into insertion path 1310, contacts 1230 including contacting portions 1232 may remain out of the insertion path 1310, and are thereby protected from an oblique insertion. In various embodiments of the present invention, a spring or other force may be used to maintain contacts 1230 out of card path 1310 when a card is not inserted fully or nearly fully in connector receptacle 1220. In FIG. 14, card 1200 is being inserted into insertion path 1310 in housing 1220. In FIG. 15, card 1200 has been inserted into receptacle 1220. Rear housing portion 1240 has rotated around location 1242 such that contacting portions 1232 of contacts 1230 are brought into contact with corresponding contacts on a bottom side of card 1200. Similarly, contacting portions 1272 of contacts 1270 are also brought into electrical contact with contacts on an underside of card 1200.

In various embodiments of the present invention, the components of the receptacles may be formed in various ways of various materials. For example, contacts or pins and other conductive portions of the receptacles may be formed by stamping, metal-injection molding, machining, micromachining, 3-D printing, or other manufacturing process. The conductive portions may be formed of stainless steel, steel, copper, copper titanium, phosphor bronze, or other material or combination of materials. They may be plated or coated with nickel, gold, or other material. The nonconductive portions, such as the protective pieces, receptacle housings and other portions may be formed using injection or other molding, 3-D printing, machining, or other manufacturing process. The nonconductive portions may be formed of silicon or silicone, rubber, hard rubber, plastic, nylon, elastomers, liquid-crystal polymers (LCPs), ceramics, or other nonconductive material or combination of materials.

Embodiments of the present invention may provide receptacles that may be located in, and may connect to, various types of devices, such as portable computing devices, tablet computers, desktop computers, laptops, all-in-one computers, wearable computing devices, cell phones, smart phones, media phones, storage devices, portable media players, navigation systems, monitors, power supplies, adapters, remote control devices, chargers, and other devices. These connector receptacles may provide pathways for signals and power for cards or other modules, such as Secure Digital cards, Secure Digital High Capacity cards, Secure Digital Extended Capacity cards, Secure Digital Ultra-High-Capacity I cards, Secure Digital Ultra-High-Capacity II cards, memory sticks, compact flash cards, communication modules, and other devices and modules that have been developed, are being developed, or will be developed in the future. These connector receptacles may provide pathways for signals that are compliant with various standards such as Universal Serial Bus (USB), High-Definition Multimedia Interface® (HDMI), Digital Visual Interface (DVI), Ethernet, DisplayPort, Thunderbolt™, Lightning™, Joint Test Action Group (JTAG), test-access-port (TAP), Directed Automated Random Testing (DART), universal asynchronous receiver/transmitters (UARTs), clock signals, power signals, and other types of standard, non-standard, and proprietary interfaces and combinations thereof that have been developed, are being developed, or will be developed in the future.

The above description of embodiments of the invention has been presented for the purposes of illustration and description. It is not intended to be exhaustive or to limit the invention to the precise form described, and many modifications and variations are possible in light of the teaching above. The embodiments were chosen and described in order to best explain the principles of the invention and its practical applications to thereby enable others skilled in the art to best utilize the invention in various embodiments and with various modifications as are suited to the particular use contemplated. Thus, it will be appreciated that the invention is intended to cover all modifications and equivalents within the scope of the following claims.

What is claimed is:

1. A connector receptacle comprising:

a first contact;

a first piece around a portion of the first contact such that a contacting portion of the first contact is exposed;

a second contact; and a second piece around a portion of the second contact such that a contacting portion of the second contact is exposed, wherein a tab on the first piece fits in a slot in the second piece such that the first piece and the second piece are interlocking.

2. The connector receptacle of claim 1 wherein the first contact is conductive and the first piece is nonconductive.

3. The connector receptacle of claim 2 wherein the first piece is formed of plastic.

4. The connector receptacle of claim 1 wherein the tab on the first piece extends lengthwise along a length of the first contact and the slot in the second piece extends lengthwise along a length of the second contact.

5. The connector receptacle of claim 4 wherein the first piece and the second piece are located in a single opening in an opening in a bottom surface of a housing for the connector receptacle.

6. The connector receptacle of claim 1 wherein the connector receptacle is a receptacle for a secure digital card.

7. The connector receptacle of claim 1 wherein the connector receptacle is a receptacle for a secure digital ultra-high-speed II card.

8. A connector receptacle comprising:

a first contact;

a first piece around a portion of the first contact such that a contacting portion of the first contact is exposed;

a second contact; and a second piece around a portion of the second contact such that a contacting portion of the second contact is exposed, wherein the first piece and the second piece are adjacent to each other and a tab on the first piece fits in a slot in the second piece such that the first piece and the second piece are interlocking.

9. The connector receptacle of claim 8 wherein the first piece and the second piece are interlocking.

10. The connector receptacle of claim 9 wherein the tab on the first piece extends lengthwise along a length of the first contact and the slot in the second piece extends lengthwise along a length of the second contact.

11. The connector receptacle of claim 10 wherein the first piece and the second piece are located in a single opening in an opening in a bottom surface of a housing for the connector receptacle.

12. The connector receptacle of claim 8 wherein the first piece and the second piece are plastic.

13. The connector receptacle of claim 8 wherein the connector receptacle is a receptacle for a secure digital card.

14. The connector receptacle of claim 8 wherein the connector receptacle is a receptacle for a secure digital ultra-high-speed II card.

15. A connector receptacle comprising:

a housing having a plurality of openings in a bottom surface;

a first contact;

a first piece around a portion of the first contact such that a contacting portion of the first contact is exposed;

a second contact; and a second piece around a portion of the second contact such that a contacting portion of the second contact is exposed, wherein a tab on the first piece fits in a slot in the second piece such that the first piece and the second piece are interlocking, and wherein the first piece and the second piece are located in a single opening in an opening in the bottom surface of the housing.

16. The connector receptacle of claim 15 wherein the first piece and the second piece are adjacent.

17. The connector receptacle of claim 16 wherein the first piece and the second piece are interlocking.

18. The connector receptacle of claim 15 wherein the tab on the first piece extends lengthwise along a length of the first contact and the slot in the second piece extends lengthwise along a length of the second contact.

19. The connector receptacle of claim 15 wherein the connector receptacle is a receptacle for a secure digital card.

20. The connector receptacle of claim 15 wherein the connector receptacle is a receptacle for a secure digital ultra-high-speed II card.

* * * * *